US012692047B2

(12) United States Patent
Beardsell

(10) Patent No.: US 12,692,047 B2
(45) Date of Patent: Jul. 28, 2026

(54) CUP HAVING A ROTATABLE HANDLE

(71) Applicant: SHAKESPHERE PRODUCTS LIMITED, Salford (GB)

(72) Inventor: Richard Beardsell, Salford (GB)

(73) Assignee: SHAKESPHERE PRODUCTS LIMITED, Salford (GB)

( * ) Notice: Subject to any disclaimer, the term of this patent is extended or adjusted under 35 U.S.C. 154(b) by 31 days.

(21) Appl. No.: 18/630,967

(22) Filed: Apr. 9, 2024

(65) Prior Publication Data

US 2025/0197065 A1 Jun. 19, 2025

(30) Foreign Application Priority Data

Dec. 15, 2023 (CN) ..... 202323455708.X

(51) Int. Cl.
*B65D 25/28* (2006.01)
*A47G 23/02* (2006.01)
*B65D 47/26* (2006.01)

(52) U.S. Cl.
CPC ..... *B65D 25/28* (2013.01); *A47G 23/0216* (2013.01); *B65D 47/26* (2013.01); *B65D 2525/282* (2013.01); *B65D 2525/288* (2013.01)

(58) Field of Classification Search
CPC ..... B65D 25/2852; B65D 2525/282; B65D 2525/288
USPC .... 220/764, 710.5, 757, 762, 846; 16/111.1, 16/320, 331, 334
See application file for complete search history.

(56) References Cited

U.S. PATENT DOCUMENTS 5,671,503 A * 9/1997 Uebelacker ..... B65D 25/2811 220/756
5,823,385 A * 10/1998 Cautereels ..... B65D 25/282 220/762
7,611,029 B2 * 11/2009 Wong ..... B65D 47/286 220/780
2023/0322444 A1 * 10/2023 Petre ..... B65D 25/2844 220/764
2024/0092535 A1 * 3/2024 Bram ..... B65D 25/20
2024/0409271 A1 * 12/2024 Liu ..... B65D 25/282

FOREIGN PATENT DOCUMENTS

CN 201379359 Y * 1/2010
DE 19653228 A1 * 6/1998 ..... A47J 45/061

* cited by examiner

*Primary Examiner* — Mollie Impink
(74) *Attorney, Agent, or Firm* — Laubscher & Fretwell, P.C.

(57) ABSTRACT

A cup with a rotating handle includes a cup body, a handle, the upper end of which rotates and is connected with the side of the cup body, and a limiting mechanism, wherein the handle and the cup body are connected. The limiting mechanism configured such that when the handle rotates upward to a first angular position, it is limited thereto, and when the handle rotates downward to a second angular position, it is also limited thereto, providing convenient adjustment of the direction of the handle.

10 Claims, 6 Drawing Sheets

CUP HAVING A ROTATABLE HANDLE

BACKGROUND OF THE INVENTION

This present disclosure relates to cups, and in particular a cup with a rotating handle.

To facilitate holding and drinking, cups generally have a handle on the side, with handles possibly being "C" shaped or "L" shaped. The prior art discloses cups with handles on the side, which are suited for use in settings such as the house and the office where there are table surfaces. However, the narrowness of typical cupholders found in vehicles and the interference between the handle of the cup and the edge of the cupholder results in cups which are unusable in an in-vehicle environment. Because the cups of the prior art are limited by the settings in which they can be used, a need exists for a cup which can be used in a variety of settings.

SUMMARY OF THE INVENTION

Accordingly, it is an object of the present disclosure to provide a cup with a rotatable handle that can be conveniently adjusted to multiple positions such that it satisfies the usage requirements of an in-vehicle environment.

A cup with a rotating handle includes a cup body, a handle, the upper end of which rotates and is connected to the side of the cup body, and a position-limiting mechanism situated where the handle and the cup body connect. The position-limiting mechanism operates such that when the handle rotates upward to the first angular position, the mechanism limits it to the first angular position and when the handle rotates downward to the second angular position, the mechanism limits it to the second angular position.

In one embodiment, there is a side shaft provided on the side of the cup body and the top end of the handle possesses a shaft sleeve being in a sleeved arrangement on the outside of the side shaft. The side shaft and top end of the handle have a rotating fit.

In another embodiment, the position-limiting mechanism includes a limiting block provided on the external side wall of the side shaft, an internal ring slot opened-up on the inside of the shaft sleeve, a magnet, and a ferromagnetic component, the latter of which is secured within the side shaft. The magnet is secured within the shaft sleeve in aligned arrangement with the ferromagnetic component. The inside of the internal ring slot possessing a spacer rib, there being a first notch and a second notch opening on the spacer rib for the purpose of allowing passage of the limiting block. When the handle is rotated upward to the first angular position, the limiting block catches in the first notch, when the handle is rotated downward to the second angular position, the limiting block catches in the second notch.

Preferably, the handle is an "L" shaped handle.

In yet another embodiment, there is an accommodating cavity provided within the handle and a top cover on the top end hinge of the handle to cover the opening in the top of the accommodating cavity. A drinking tube module is provided within the accommodating cavity.

Preferably, the drinking tube module is comprised of a drinking tube sleeve and a drinking tube that is provided within the drinking tube sleeve.

In a further embodiment, there is a cup lid covering and closing the top of the cup body, the cup lid possessing a water outlet hole. The top of the cup lid posses a sliding cover that can slide back and forth for the purpose of covering and closing the water outlet hole.

Preferably, the top of the cup lid includes a limiting slot of a predetermined length and the bottom surface of the sliding cover includes a limiting protrusion. The limiting protrusion is in arrangement within the limiting slot such that the two have a sliding fit.

The cup of the present disclosure allows for rotation of the handle upward or downward to two states based on the rotation of the handle relative to the cup body. The position-limiting mechanism restricts the handle to a first angular position or second angular position after rotation. In this manner, the cup can be held in the same manner as a traditional cup, but, after the handle is rotated upwards, it is possible to insert the cup body directly into a cup holder of the type typically found in vehicles. While driving, the user can conveniently pick up the cup by grasping and lifting the handle, thus allowing convenient adjustment of the direction of the handle, and satisfying the requirements for safe and convenient in-vehicle usage.

BRIEF DESCRIPTION OF THE FIGURES

Other objects and advantages of the disclosure will become apparent from a study of the following specification when viewed in the light of the accompanying drawing, in which.

DETAILED DESCRIPTION

The present invention reveals a type of cup with a rotating handle, including a cup body 1, a handle 2, the upper end of which rotates and is connected with the side of the cup body 1, and a position-limiting mechanism, provided where the handle 2 and the cup body 1 connect. The purpose of the position-limiting mechanism is that when the handle 2 rotates upward to the first angular position, it limits it to the first angular position, and when the handle 2 rotates downward to the second angular position, it limits it to the second angular position.

Figure 6:
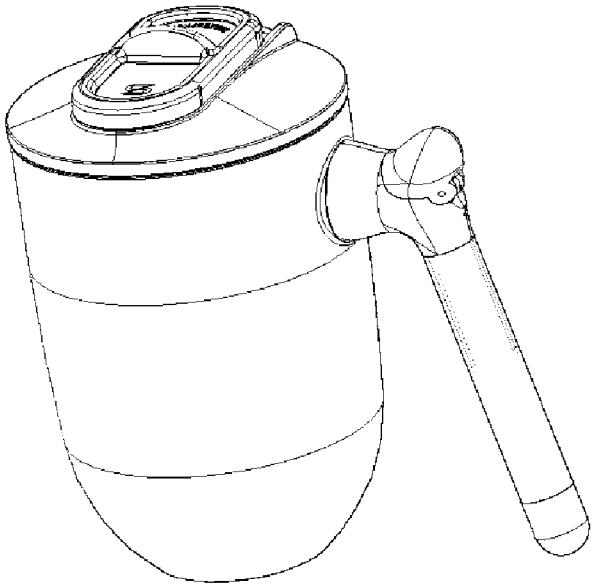
FIGS. 6 and 7 are perspective views of the cup of FIG. 1 with the handle rotated in downward and upward positions, respectively.
Figure 7:
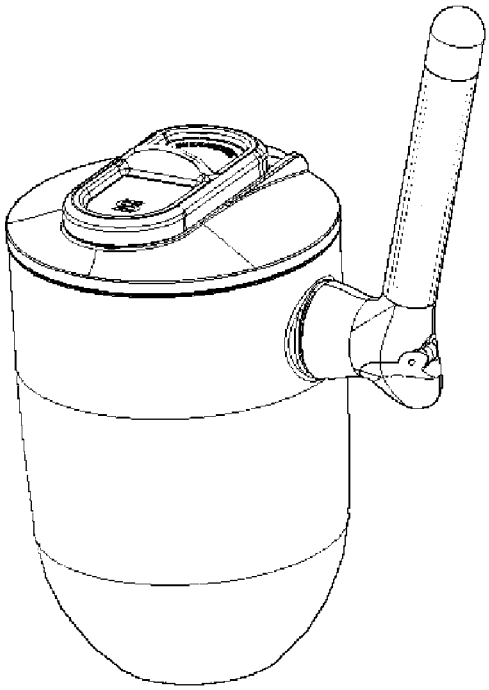

With the above structure, based on the rotation of the handle 2 relative to the cup body 1, it is possible to rotate the handle 2 upward or downward to two states as indicated by FIGS. 6 and 7. On the basis of this, the position-limiting mechanism allows restriction of the handle 2 to a first angular position or second angular position after rotation as shown in FIGS. 6 and 7. In this manner, the cup can be held in the same manner as a traditional cup, however, after the handle 2 is rotated upward, it is possible to insert the cup body 1 directly into a cupholder of the type typically found in vehicles While driving, the user can conveniently pick up the cup by grasping and lifting the handle 2.

Figure 3:
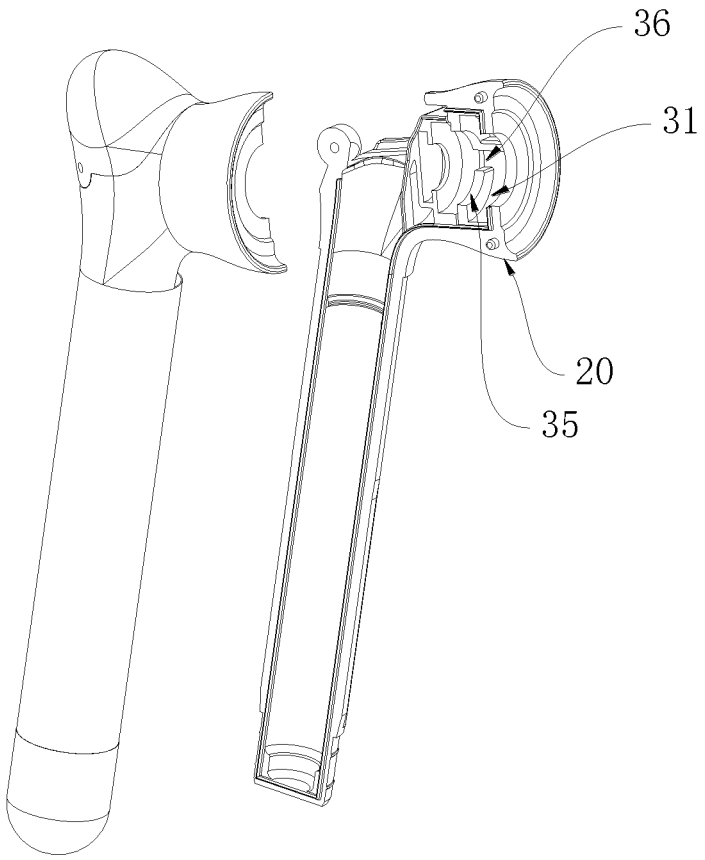
FIG. 3 is a perspective view of the interior of the handle shown in FIG. 1.

With reference to FIG. 3, concerning the preferred arrangement of the handle 2 relative to the cup body 1, there is a side shaft 10 provided on the side of the cup body 1 and a shaft sleeve at the top end of the handle 2. The shaft sleeve 20 is in a sleeved arrangement on the outside of the side shaft 10, and the side shaft and shaft sleeve have a rotating fit. The handle 2 has an "L" shaped structure.

Figure 1:
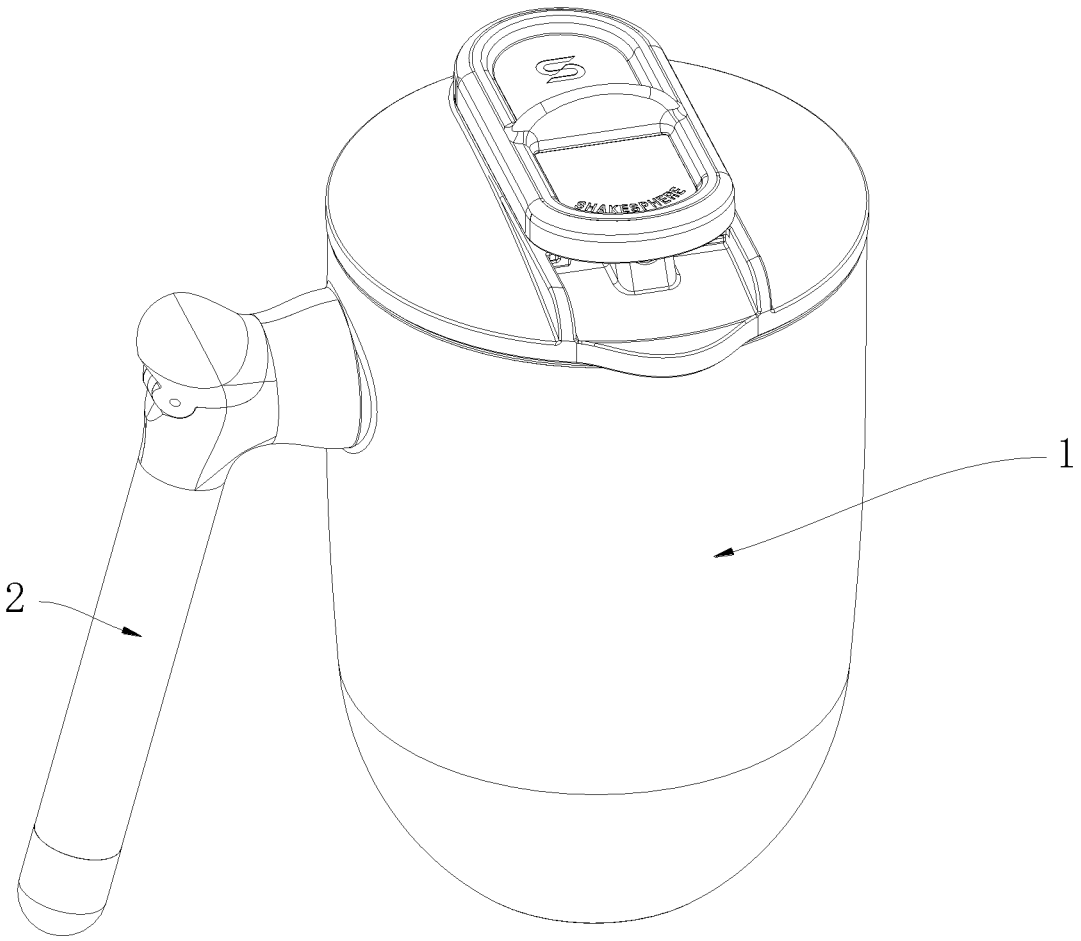
FIG. 1 is a perspective view of a cup according to the present disclosure.
Figure 2:
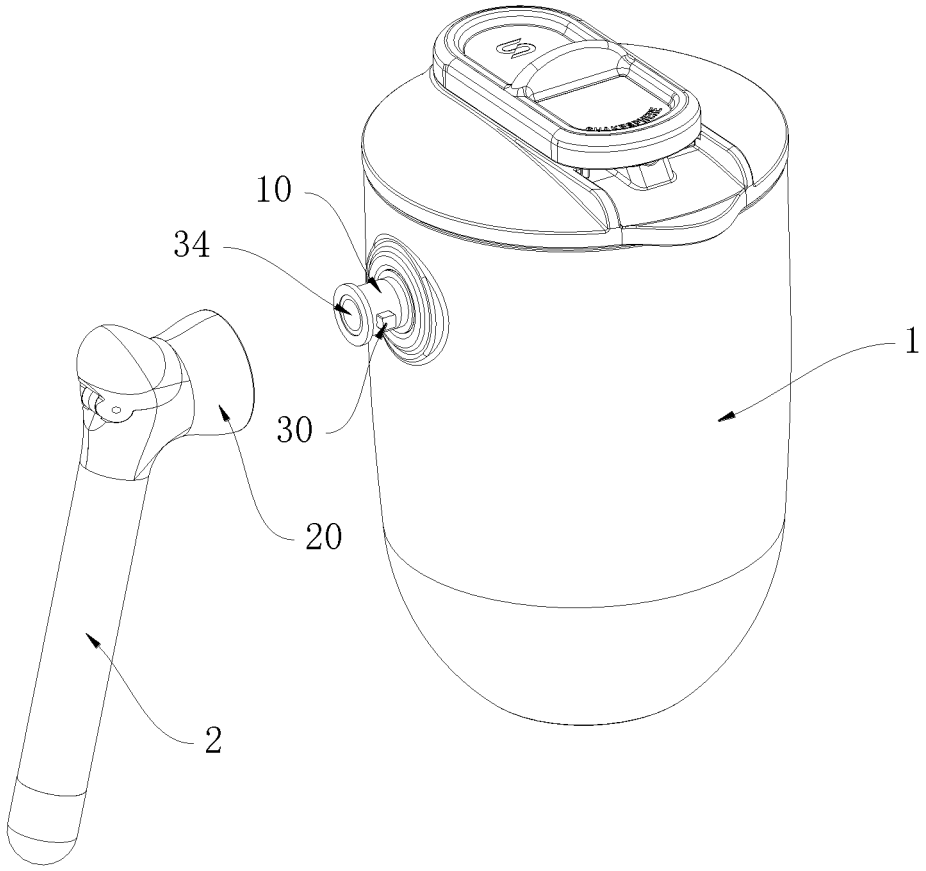
FIG. 2 is a perspective view of the cup of FIG. 1 with the handle removed.
Figure 4:
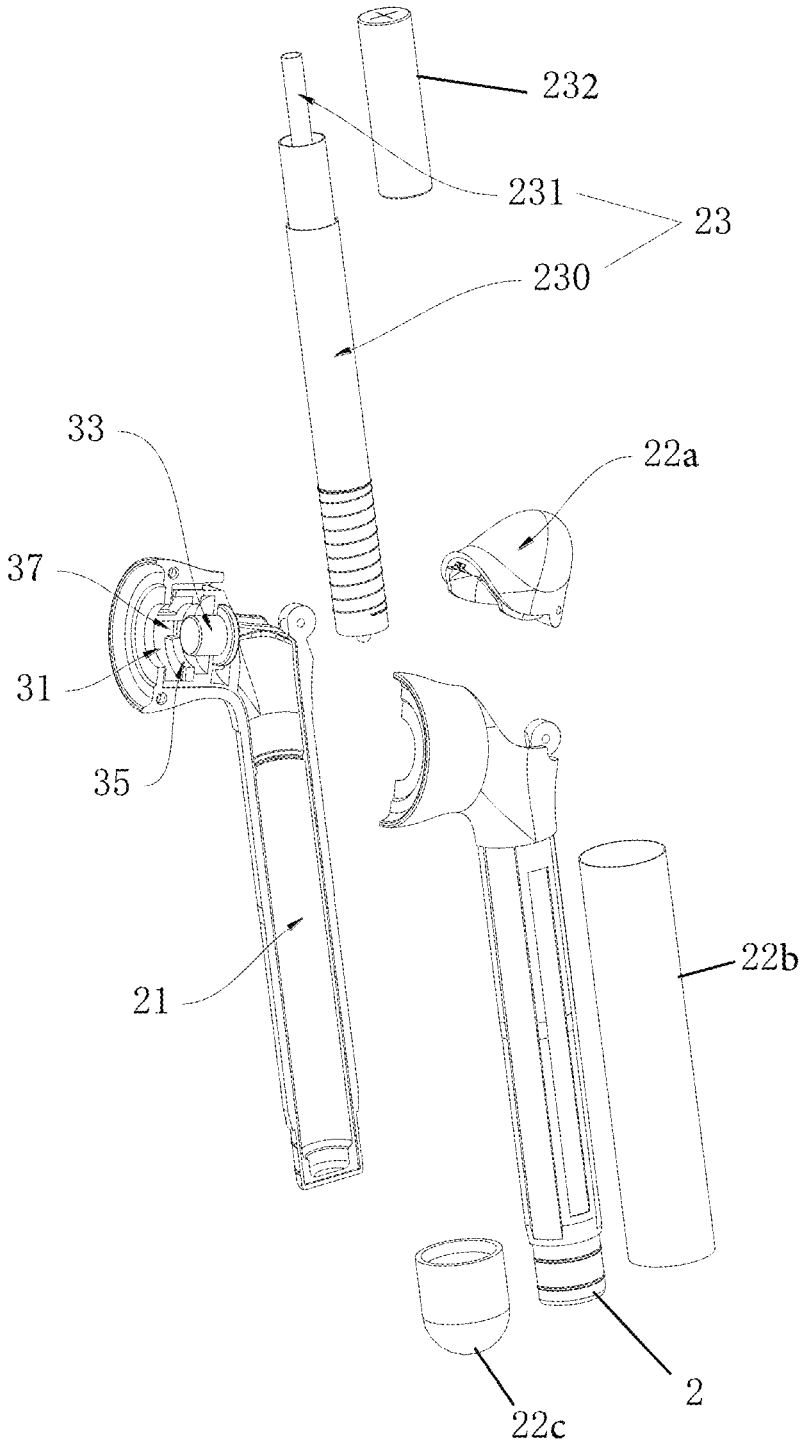
FIG. 4 is an exploded view of the handle.

Referring now to FIGS. 2-4, the position-limiting mechanism includes a limiting block 30 provided on the external side wall of the side shaft 10, an internal ring slot 31 opened-up on the inside of the shaft sleeve 20, a magnet 33 and a ferromagnetic component 34. The ferromagnetic component 34 is secured within the side shaft 10 and the magnet 33 is secured within the shaft sleeve 20. Additionally, the magnet 33 is in aligned arrangement with the ferromagnetic component 34 and the inside of the internal ring slot 31 includes a spacer rib 35, there being a first notch 36 and a second notch 37 opening-up on the spacer rib 35 to allow passage of the limiting block 30. When the handle 2 is rotated upward to the first angular position, the limiting block 30 catches in the first notch 36, and when the handle 2 is rotated downward to the second angular position, the limiting block 30 catches in the second notch 37. The angle through which the handle 2 rotates between the first angular position and the second angular position is 180°, and thus the handle 2 is adjustable to an upward vertical direction or a downward vertical direction.

When the user needs to adjust the position of the handle 2, the magnetic attraction between the magnet 33 and the ferromagnetic component 34 is first overcome by pulling the handle 2 outward by approximately 2 mm, causing the limiting block 30 to separate from the first notch 36. Then the handle 2 is rotated, causing the limiting block 30 to slide along the internal ring slot 31, until the handle 2 is rotated 180° and the limiting block 30 aligns with the second notch 37. The limiting block 30 then catches in the second notch 37 due to the magnetic attraction between the magnet 33 and the ferromagnetic component 34, causing the handle 2 to be held in position after rotation. The structure of the above position-limiting mechanism is simple, its position-limiting principles are reliable, and it can be conveniently operated and used by the user.

In a preferred embodiment, there is an accommodating cavity 21 provided within the handle 2, there being a top cover 22*a* on the top end hinge of the handle 2 to cover the opening in the top of the accommodating cavity 21, along with a body central cover 22*b* and bottom cover 22*c*. There is a drinking tube module 23 provided within the accommodating cavity 21, which includes a drinking tube sleeve 230, a drinking tube 231 within the sleeve 230, and a sleeve top 232.

To extract the drinking tube 231 within the handle 2, the user opens the top cover 22. Thus, the user does not need to carry any other drinking tube such as a straw, thus improving convenience and utility even more. Preferably, the cup described herein is used as a coffee cup.

Figure 5:
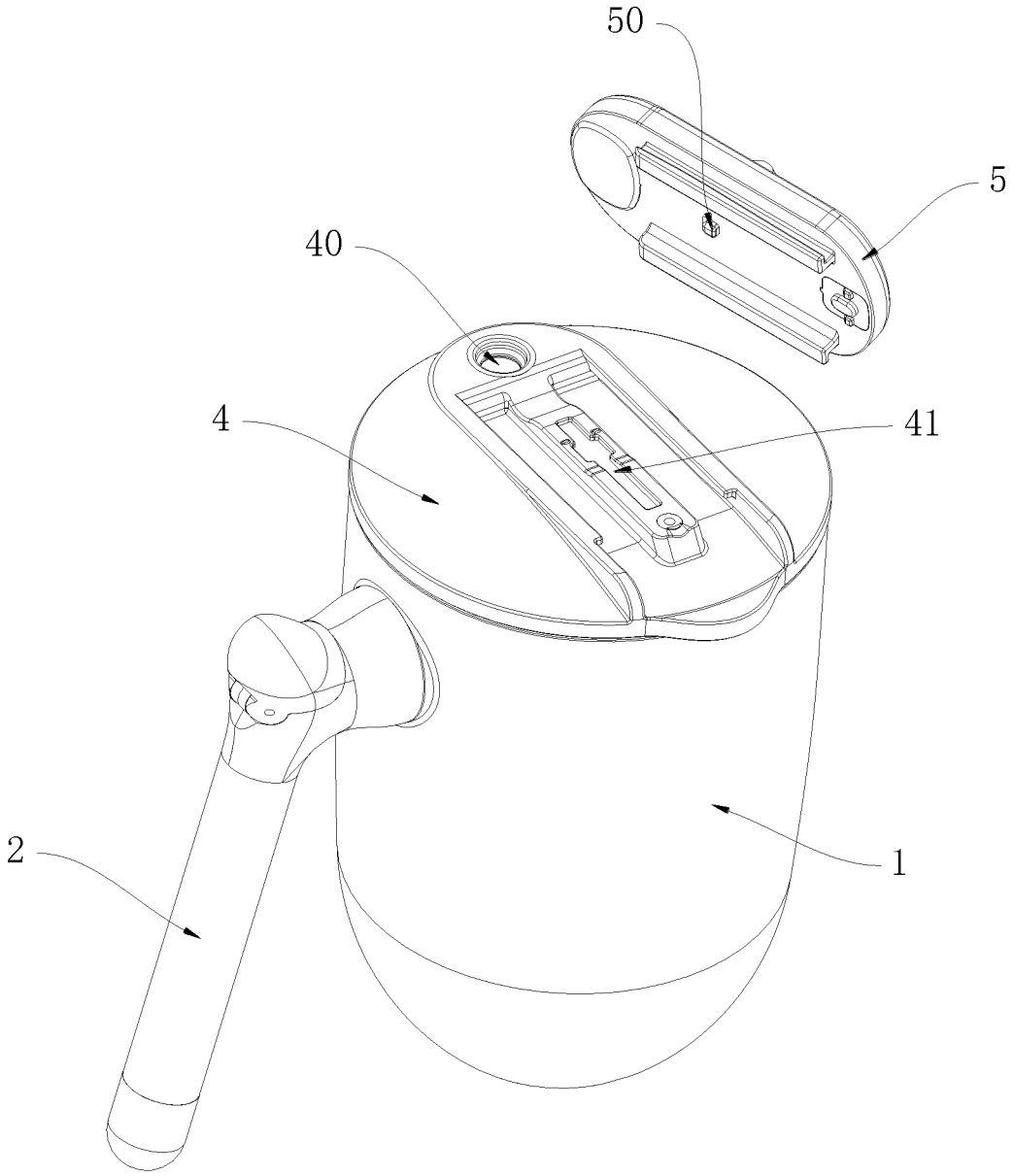
FIG. 5 is a perspective view of the cup of FIG. 1 with the cover removed.

Referring to FIG. 5, there is a cup lid 4 covering and closing the top of the cup body 1. The cup lid 4 includes a water outlet hole 40 and the top of the cup lid 4 includes a sliding cover 5 that can slide back and forth to cover and close the water outlet hole 40. Furthermore, the top of the cup lid 4 has a limiting slot 41 of a predetermined length and the bottom surface of the sliding cover 5 includes a limiting protrusion 50 in arrangement within the limiting slot 41. The limiting slot and limiting protrusion have a sliding fit which limits the sliding travel of the sliding cover 5, preventing the sliding cover 5 from sliding out and detaching from the cup lid 4.

The above is solely a preferred embodiment of the cup, and does not constitute any restriction on the present invention. As such, all like for like replacements or enhancements etc. carried out that fall within the technical scope of the present invention shall be treated as falling within the scope of protection afforded the disclosed cup.

What is claimed is:

1. A cup having a handle, comprising:

(a) a cup body having at least one side wall and a side shaft arranged thereon;

(b) a handle having a rotatable top end and a shaft sleeve, the handle being rotatably connected with the side wall of the cup body for rotation between a first angular position and a second angular position;

(c) a limiting mechanism arranged at an interface between the handle and the cup body including a limiting block arranged on a side wall of the side shaft, an internal ring slot and magnet arranged inside of the shaft sleeve, and a ferromagnetic component arranged within the side shaft, the magnet being in aligned arrangement with the ferromagnetic component, the internal ring slot including a spacer rib, having a first notch and a second notch which provide passage of the limiting block, whereby when the handle rotates upward to the first angular position, the limiting block catches in the first notch, and when the handle rotates downward to the second angular position, the limiting block catches in the second notch.

2. The cup having a handle according to claim 1, wherein the handle has an L-shaped configuration.

3. The cup having a handle according to claim 1, wherein the handle includes an accommodating cavity having an open upper end and a moveable cover connected with the upper end of the handle to covering the open upper end, a drinking tube module being arranged within the accommodating cavity.

4. The cup having a handle according to claim 3, wherein the drinking tube module is comprised of a drinking tube sleeve and a drinking tube arranged within the drinking tube sleeve.

5. The cup having a handle according to claim 1, wherein a cup lid covers a top of the cup body, the cup lid containing an outlet and a moveable cover configured to cover the outlet.

6. The cup having a handle according to claim 5, wherein a top of the cup lid includes a limiting slot having a length and a bottom surface of the moveable cover includes a limiting protrusion, the limiting protrusion being in arrangement with the limiting slot, to provide a sliding fit.

7. A cup having a handle, comprising a cup body having at least one side wall, a handle rotatably connected with the at least one side wall, and a handle rotation assembly arranged at an upper end of the handle and including a pair of magnets, a rotation channel, and a limiting block, the handle rotation assembly being adjustable between a rotation position when the limiting block is arranged within the rotation channel and at least one locking position when a retaining force of the pair of magnets prevents movement of the limiting block, whereby when the rotation assembly is in its rotation position, the handle is rotatable between at least two locking positions.

8. The cup having a handle according to claim 7, wherein the rotation assembly further includes at least one notch, the limiting block being arranged therein when in the locking position.

9. The cup having a handle according to claim 8, the side wall having a side shaft arranged thereon, wherein at least one of the rotation channel and limiting block are arranged on the side shaft.

10. The cup having a handle according to claim 7, wherein when the rotation assembly is in the locking position an upper end of the handle is arranged in closer proximity to the at least one side wall than when the rotation assembly is in the rotation position, one of the pair of magnets being arranged within a cavity of the upper end of the handle and the other of the pair of magnets being arranged on the cup body side wall.

* * * * *